US010919724B1

(12) United States Patent
Treme

(10) Patent No.: US 10,919,724 B1
(45) **Date of Patent: *Feb. 16, 2021**

(54) TIE-WIRE HOLSTER

(71) Applicant: Cameron J. Treme, Albuquerque, NM (US)

(72) Inventor: Cameron J. Treme, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/889,099

(22) Filed: Jun. 1, 2020

Related U.S. Application Data

(63) Continuation-in-part of application No. 15/945,002, filed on Apr. 4, 2018, now Pat. No. 10,710,836.

(51) Int. Cl.
*B65H 49/08* (2006.01)

(52) U.S. Cl.
CPC ..... *B65H 49/08* (2013.01); *B65H 2402/413* (2013.01); *B65H 2511/142* (2013.01); *B65H 2701/362* (2013.01)

(58) Field of Classification Search
CPC ..... B65H 75/28; B65H 75/406; B65H 75/22; B65H 75/40; B65H 49/205; B65H 75/48; B65H 75/4473; B65H 37/005; B65H 2402/41; B65H 2402/411
See application file for complete search history.

(56) References Cited

U.S. PATENT DOCUMENTS

| | | | | |
|---|---|---|---|---|
| 2,364,262 | A | 12/1944 | Wehringer | |
| 2,982,492 | A | 5/1961 | Spielman | |
| 3,062,475 | A | 11/1962 | Miller | |
| 3,378,215 | A | 4/1968 | Wilson | |
| 3,384,140 | A | 5/1968 | Brothers | |
| 5,779,175 | A | 7/1998 | Shirahase | |
| 5,992,787 | A | 11/1999 | Burke | |
| 6,065,709 | A | 5/2000 | Wagter | |
| D456,692 | S | 5/2002 | Epstein | |
| 7,032,854 | B2 | 4/2006 | Marsden | |
| 7,654,484 | B2 | 2/2010 | Mogensen | |
| 8,230,995 | B2 | 7/2012 | Andrews | |
| 10,710,836 | B1 * | 7/2020 | Treme | B65H 75/141 |
| 2003/0038209 | A1 | 2/2003 | Remeczky | |
| 2003/0132339 | A1 | 7/2003 | McCarthy | |
| 2017/0231375 | A1 | 8/2017 | Moreau | |

OTHER PUBLICATIONS

Photographs of device in public use in the United States prior to Apr. 4, 2018.

* cited by examiner

*Primary Examiner* — William A. Rivera
(74) *Attorney, Agent, or Firm* — Jones Walker LLP

(57) ABSTRACT

A tie-wire holster having a tire-shaped body formed of a flexible polymer material. The body includes sidewalls having first and second central openings, and at least two slots formed in the first sidewall, the slots extending from the central opening of the first sidewall into a top circumferential portion. A spool-shaped attachment member with a first flange and a second flange, the second flange sized to extend though the body's second central opening and the first flange sized to not be capable of extending through the second central opening. The first flange is positioned against an interior of the second sidewall and the second flange is positioned against an exterior of the second sidewall.

20 Claims, 5 Drawing Sheets

TIE-WIRE HOLSTER

I. CROSS REFERENCE TO RELATED APPLICATION

This application is a continuation-in-part of U.S. application Ser. No. 15/945,002, filed Apr. 4, 2018, which is incorporated by reference herein in its entirety.

II. BACKGROUND

The present invention generally relates to devices for carrying rolls of wire and dispensing lengths of wire from such rolls. Comparatively small gauge wire, e.g., 16 gauge rebar tie wire, is used throughout the construction industry. Often such wire is distributed in a simple roll secured only by two short segments of small gauge "bounding wire" tied around the roll in order to maintain the roll in its ring or toroidal shape. These short segments of holding wire are typically removed when the main wire roll is put into use. Once these segments of holding wire are removed, it is very easy for the wire to lose its compact toroidal shape and expand to an unwieldy size/shape or to become tangled.

In order to keep a wire roll in its compact toroidal shape, but still allow discrete lengths to be pulled off the roll and cut, different devices have been developed, see for example U.S. Pat. No. 3,378,215 and US Published Application No. 2003/0132339. Nevertheless, there is still a need for wire handling/dispensing devices which are more compact and more economical to manufacture.

III. BRIEF DESCRIPTION OF DRAWINGS

IV. DETAILED DESCRIPTION OF SELECTED EMBODIMENTS

Figure 1:
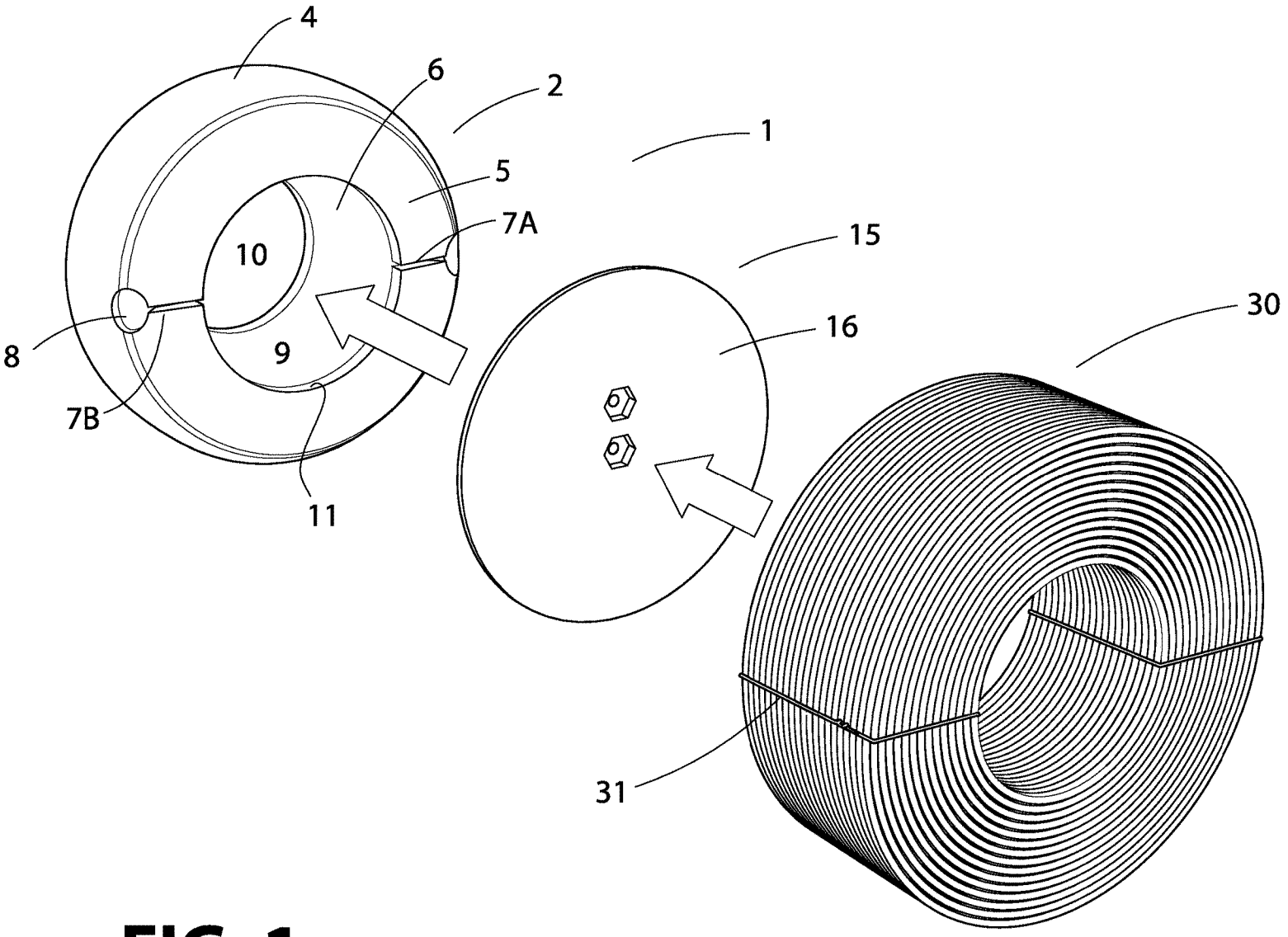
FIG. 1 illustrates an exploded view of one embodiment of the tie-wire holster of the present invention.
Figure 3:
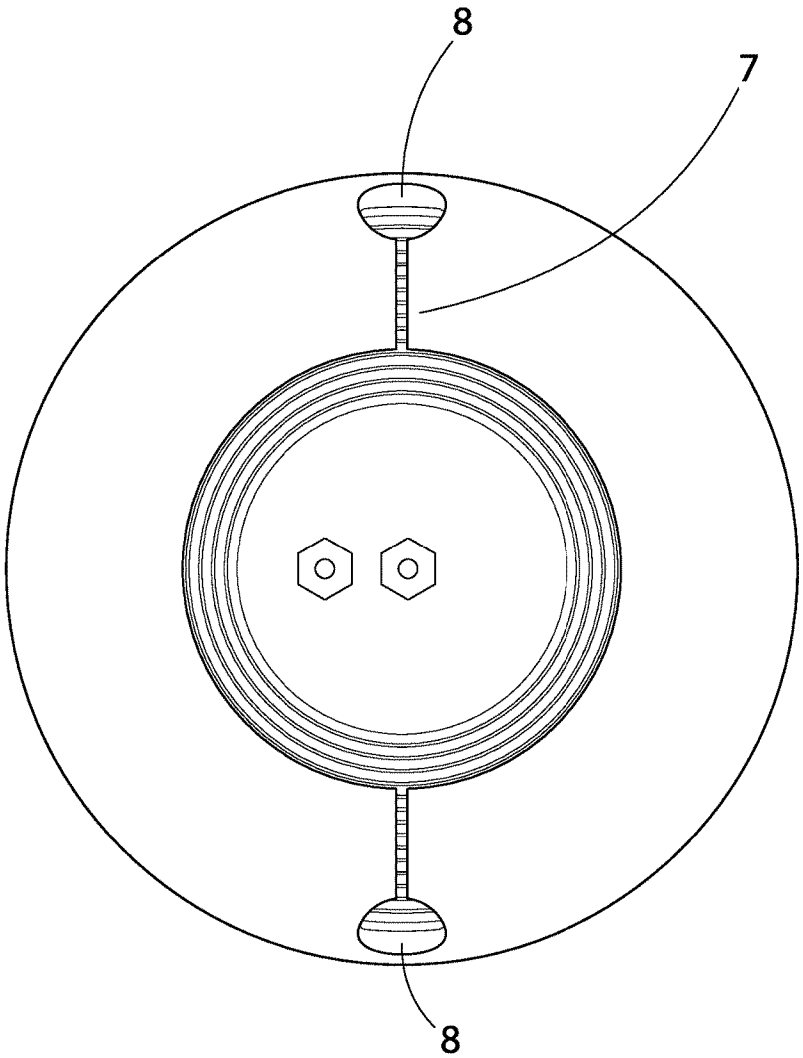
FIG. 3 is an assembled planar view of the FIG. 1 tie-wire holder.
Figure 2:
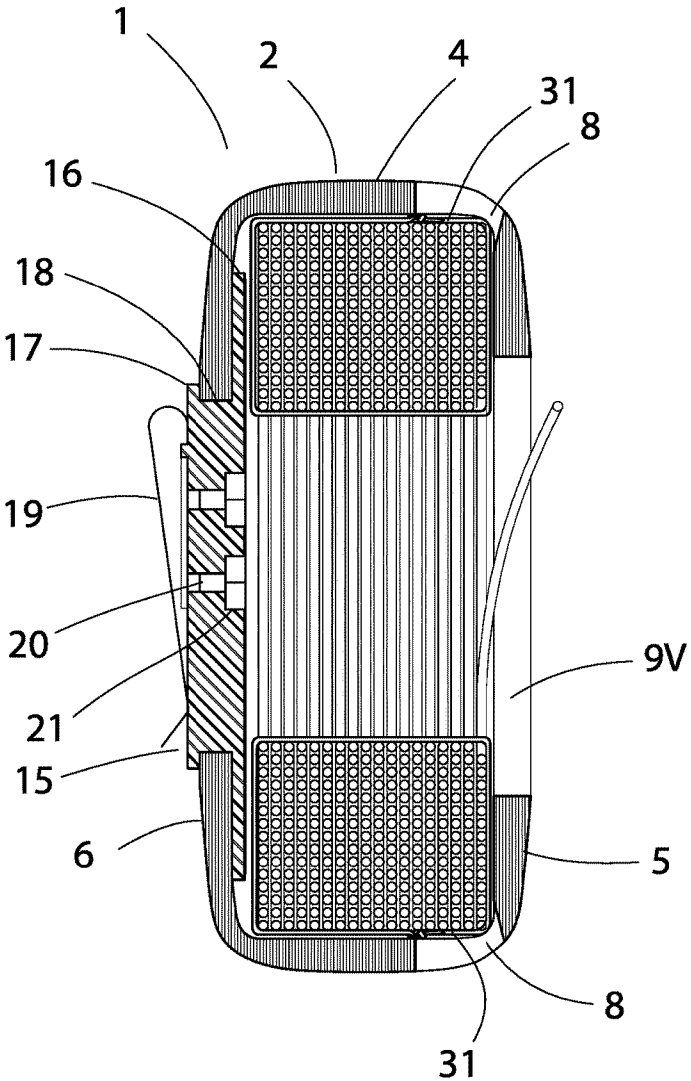
FIG. 2 is a cross-sectional view of the FIG. 1 tie-wire holster with a roll of wire positioned therein.

One embodiment of the tie-wire holster of the present invention is shown in FIGS. 1-11. Viewing FIGS. 1 and 2, the tie wire holster 1 very generally includes the tire shaped holster body 2 and the spool shaped attachment member 15. FIG. 1 shows the tie-wire roll 30 outside of holster body 2 and FIG. 2 shows roll 30 inside holster body 2. In one embodiment, wire roll 30 is formed of 16 gauge steel wire. Holster body 2 has a top circumferential portion 4 with a first radially inward extending sidewall 5. The first sidewall 5 extends from the edge of circumferential portion 4 to the first central opening 9. The opposing second sidewall 6 likewise extends radially inward and terminates at second central opening 10. Viewing FIG. 1, it is immediately apparent how this embodiment of holster body 2 may be considered "tire shaped."

The holster body 2 further includes two opposing sidewall slots 7A and 7B formed in first sidewall 5. In the illustrated embodiment, the slots 7A and 7B extend from the inner edge 11 of first central opening until the slots terminate on the edge of the top circumferential portion 4 of the holster body. The figures also show how this embodiment of slots 7A and 7B includes an enlarged section or "tension relief circle" 8 at the end of the slots 7 which intersect circumferential portion 4. In certain embodiments, the outer diameter of body 2 (i.e., from one outside surface of the circumferential portion to the opposing outside surface of the circumferential portion) will be between about 3.5 and about 12 inches (or any subrange in between), but more typically between about 4 and 7 inches. In such embodiments, the central opening 9 will be between about 0.5 and about 8 inches in diameter (or any subrange in between) and the central opening 10 will be between about 1.4 and about 3 inches in diameter. The tension relief circles 8 in these embodiments will be between about 0.25 an about 1.25 inches in diameter. FIG. 2 shows how in a preferred embodiment, tension relief circles 8 are positioned predominantly on the circumferential portion 4. However, in other embodiments, tension relief circles 8 could be centered on the transition point from sidewall 5 to circumferential portion 4, or could be positioned with more of their area on sidewall 5.

In one embodiment, where the tie-wire roll 30 has an outer diameter of 4.5 inches, the outer diameter of holster body 2 will be about 5 inches, first central opening 9 about 3 inches, second central opening 10 about 2 inches, and tension relief circles 8 about ¾ inch. Of course, these dimensions are merely illustrative examples and other dimensions are possible in other embodiments. FIG. 1 shows two bounding wires 31 (also referred to as retaining segments 31) of smaller gauge wire securing tie-wire roll 30 together. Naturally, retaining segments could be zip-ties or other methods of keeping the tie-wire in the rolled state.

Figure 4:
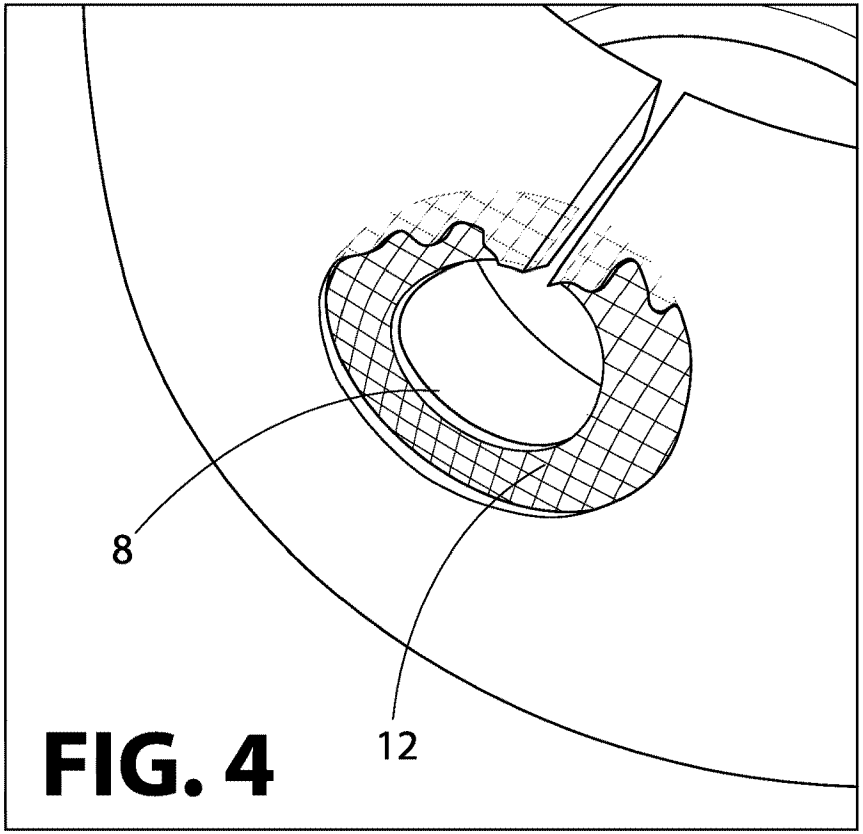
FIG. 4 illustrates an alternative material used in the holster body.

Holster body 2 will generally be formed from a unitary section of a flexible polymer material. Nonlimiting examples of such polymers could include polyurethanes, silicones, latexes, and similar polymers. Typically these materials will be formed into holster body 2 using a conventional (or future developed) molding technique such as injection molding or roto-molding. In preferred embodiments, the polymer material will have a durometer value of between about Shore A 15 and about Shore A 80 (or any sub-range in between). A particular example material is PT Flex 50TM Liquid Rubber™ two-part polyurethane system (Shore A 60) available from Polytek Development Corp. of Easton, Pa. The thickness of the polymer material in these preferred embodiment can range between about 80 mils and 280 mils. FIG. 4 suggests how in certain embodiments, a reinforcing mesh material may be incorporated into the polymer material of body 2. In the FIG. 4 embodiment, the mesh 12 is positioned mainly in the vicinity of tension relief circles 8 since that is a portion of body 2 most subject to bending forces. As one nonlimiting example, mesh 12 could be 20 (wires/inch) T304 stainless steel 0.016 (wire diameter) mesh.

Figure 5:
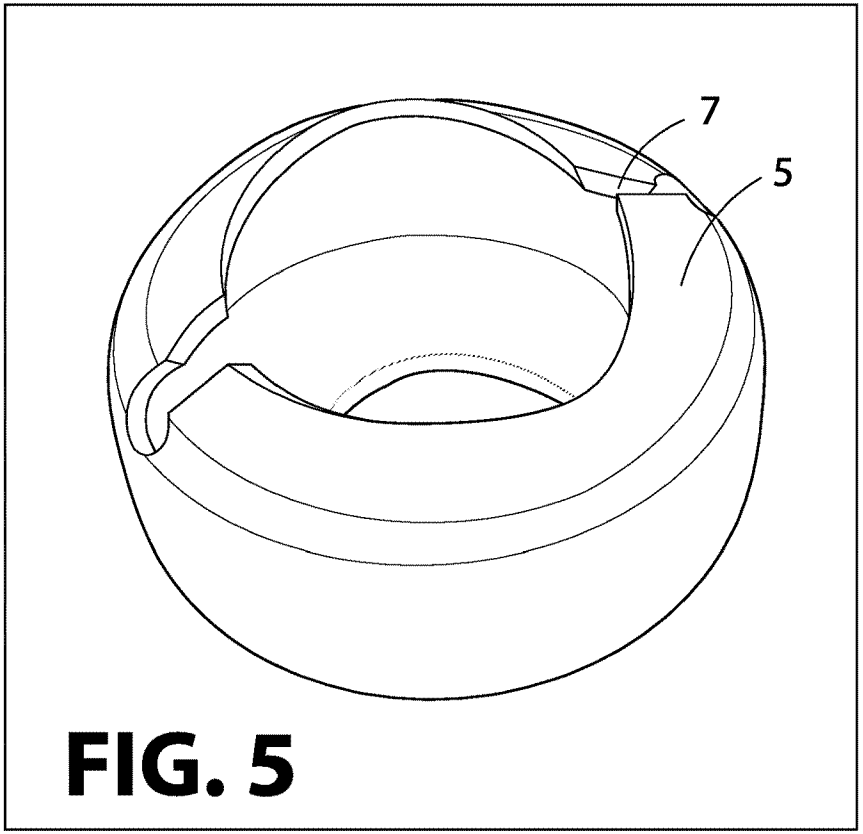
FIG. 5 is a perspective view of holster housing with the sidewalls spread apart.

FIG. 5 suggests how the slots 7 in the first sidewall 5 enable the sidewall to spread apart sufficiently to insert a tie-wire roll 30 into the interior of the holster body. It will be understood that this advantageous functionality arises from the relatively flexible material (Shore A 15 to 75) combined with slots 7. While FIG. 5 shows the slots extending from the central opening into the circumferential portion, in other embodiments, the slots may extend from the central opening to at least half the distance to the top circumferential portion, or alternatively, at least two-thirds this distance. FIG. 5 also suggests how certain embodiments will position the slots at equal angular distances from one another. For example, FIG. 5 shows the two slots approximately 180° apart, while three slots would be about 120° apart, four slots about 90° apart, etc.

As seen in FIG. 2, this example of holster body 2 has an inner diameter which is approximate the outer diameter of the tie-wire roll 30. For example, the inner diameter of holster body 2 is no more than 10% greater than the outer diameter of tie-wire roll 30 (and is generally no greater than any percentage between 1% and 30%). As suggested in FIG. 2, the inner end of wire roll 20 will extend out of first central opening 9 while the out end of wire roll 30 will be held in place by the inner surface of holster body 2 (i.e., adjacent to top circumferential portion 4). FIG. 2 also suggests how retaining segments 31 are aligned with slots 7, thereby allowing the nose of wire cutters to be inserted at tension relief circles 8 and to snip retaining segments 31 after the roll is securely in holster body 2.

Figure 6:
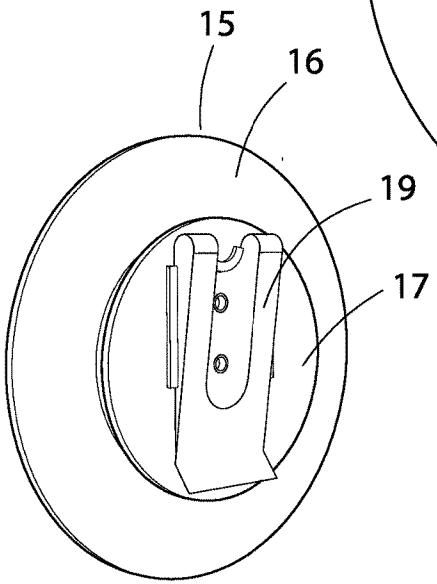
FIG. 6 illustrates an embodiment of a belt clip on an attachment member.

FIGS. 1 and 6 show the opposing sides of the spool-shaped attachment member 15. It can be seen that the attachment member 15 includes a first flange 16 which is connected to a second flange 17 via a web portion 18 (seen in FIG. 2). In the illustrated embodiment, the first flange 16 has a larger diameter than the second flange 17, both of which are larger in diameter than the web portion 18. As best seen in FIG. 2, the illustrated embodiment sizes web portion 18 so it's diameter is approximate (or slightly larger than) to the diameter of second central opening 10. The second flange 17 is sized somewhat larger than second central opening 10, but not so large than second flange 17 cannot be forced through second central opening 10 given the flexible nature of the holster material. On the other hand, first flange 16 is sufficiently large that it cannot readily be forced through second central opening 10, and preferably, its diameter approaches that of the inner diameter of holster body 2. In one nonlimiting example, where the diameter of the second central opening is 2 inches, the diameter of the first flange 16 is approximately 3.7 inches and the diameter of second flange 17 is approximately 2.5 inches.

In many embodiments, attachment member 15 is formed of a rigid plastic, such as a polyamide, a polycarbonate, a polyethylene, a polystyrene, and functionally similar polymers, by way of an injection molding or roto-molding process. In one preferred embodiments, the plastic is a polylactic acid polymer having a Shore A hardness range of between about 60 and about 100. Alternatively, the attachment member 15 could be formed of a metal such as aluminum or steel.

Figure 7:
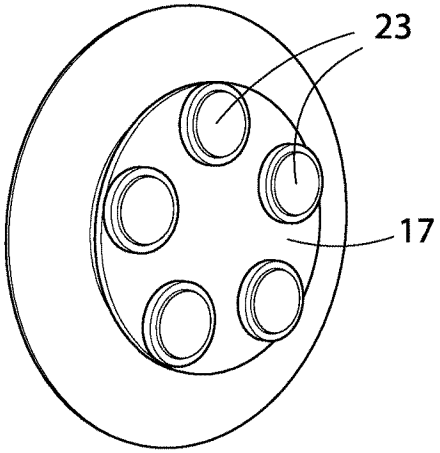
FIG. 7 illustrates an embodiment of magnets on the attachment member.
Figure 8:
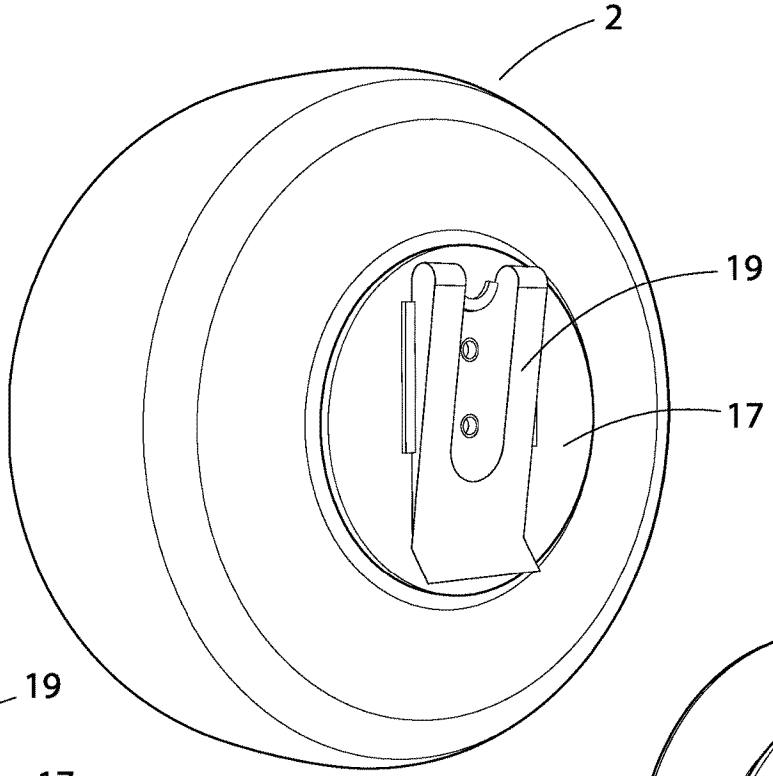
FIG. 8 illustrates the belt clip installed on the holster.

FIGS. 6 and 8 show a conventional belt clip 19 attached to the outside face of second flange 17 of attachment member 15. In one embodiment, belt clip 19 is fixed to second flange 17 via small bolts or other fasteners extending through second flange 17 (see bolts 20 and nuts 21 in FIG. 2). As an alternative to belt clip 19, FIG. 7 shows a series of magnets adhered to second flange 17, thereby allowing holster body 2 to be positioned on any reasonably flat ferromagnetic surface.

Figure 11:
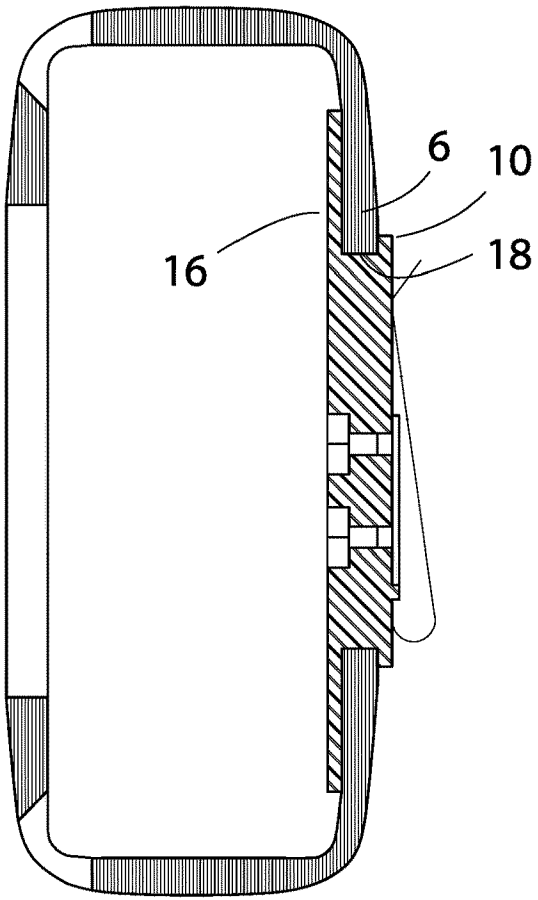
FIGS. 9 to 11 illustrate how the attachment member is installed on the holster body.
Figure 10:
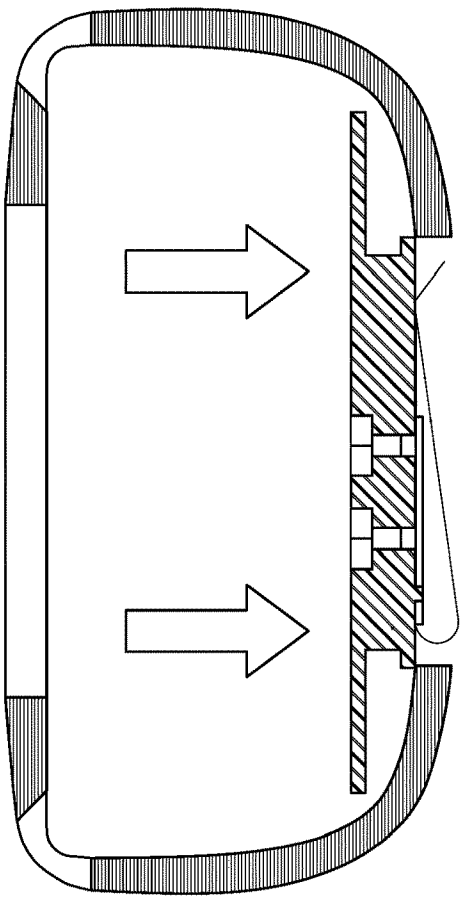
Figure 9:
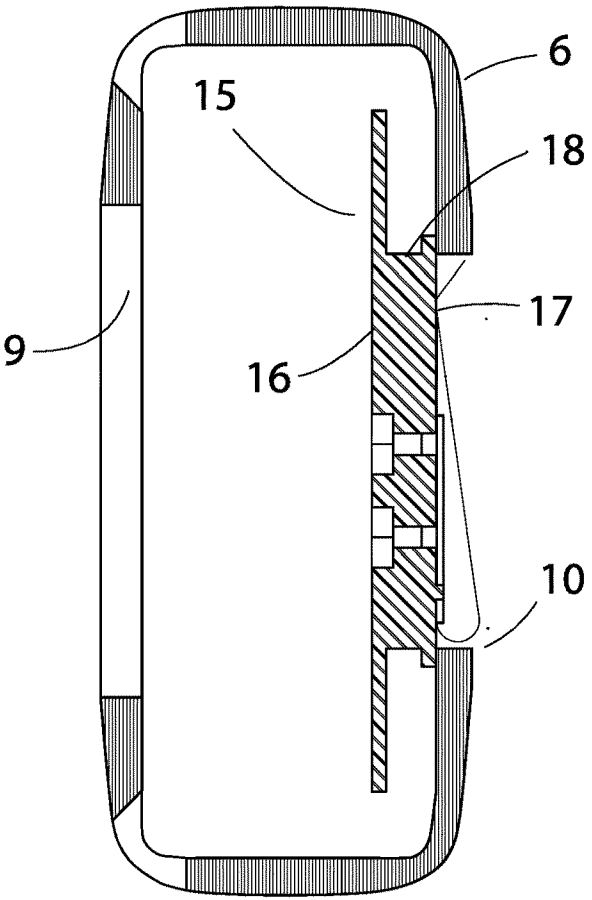

FIGS. 9 to 11 suggest how in one embodiment, attachment member 15 is positioned to engage second sidewall 6 of holster body 2. In FIG. 9, first central opening 9 is sufficiently large that the entire attachment member 15 may be inserted into the interior of holster body 2. This allows second flange 17 to be positioned against second central opening 10. While second flange 17 is somewhat larger than second central opening 10, their relative sizes are sufficiently close such that second sidewall 6 can flex and allow second flange 17 to push through second central opening 10, allowing the sidewall edges to rest against web portion 18 of attachment member 15. Since first flange 16 is too large to fit through second central opening 10, attachment member 15 securely positioned on holster body 2. Further, when the wire roll 30 is positioned in the holster body 2 as seen in FIG. 2, it is virtually impossible for attachment member 15 to become dislodged from holster body 2.

As used herein, the use of the terms "substantially" or "about" means a variation of no more than 20% of the value modified by those terms, and in some embodiments means a variation of less than 15%, 10%, 5%, or 2.5%. Although the invention had been described in terms of certain specific embodiments illustrated in the drawings, those skilled in the art will see many obvious modification and variations which are intended to be encompassed by the scope of the following claims.

The invention claimed is:

1. A tie-wire holster comprising:

(a) a tire-shaped body formed of a unitary section of flexible polymer material having a Shore A hardness of between about 15 and about 75, the body including a top circumferential portion and first and second radially inward extending sidewalls;

(b) the body having an outer diameter between about 3.5 and about 7 inches, and the sidewalls having a central opening between about 0.5 and about 5 inches in diameter;

(c) at least two slots formed in the first sidewall, the slots extending from an inner edge of the first sidewall into the top circumferential portion;

(d) a spool-shaped attachment member with a first flange and a second flange connected by a web portion, the first flange having a larger diameter than the second flange, and the first flange being positioned against an interior of the second sidewall and the second flange being positioned against an exterior of the second sidewall.

2. The tie-wire holster of claim 1, wherein the central opening in the first sidewall is larger than the central opening in the second sidewall.

3. The tie-wire holster of claim 1, wherein the slots in the first sidewall are larger at an end extending into the top circumferential portion.

4. The tie-wire holster of claim 3, wherein the enlarged end of the slot is formed predominantly in the top circumferential portion of the tire-shaped body.

5. The tie-wire holster of claim 1, wherein the polymer material around the slot ends extending into the top circumferential portion include a reinforcing mesh material.

6. The tie-wire holster of claim 1, wherein the second flange of the attachment member is sized to extend through the body's central opening and the first flange is sized to not be capable of extending through the central opening.

7. The tie-wire holster of claim 1, wherein a roll of wire is positioned within the holster body, the wire having a gauge between 14 and 18 and a free end of the wire extending out of the central opening of the first sidewall.

8. The tie-wire holster of claim 1, wherein the slots in the first sidewall enable the sidewall to spread apart sufficiently to insert a roll of tie-wire which substantially fills the interior of the holster body.

9. A tie-wire holster comprising:

(a) a tire-shaped body formed of a flexible polymer material, the body including a top circumferential portion and first and second radially inward extending sidewalls;

(b) the body having an outer diameter and the sidewalls having a central opening;

(c) at least two slots formed in the first sidewall, the slots extending from the central opening of the first sidewall into the top circumferential portion; and (d) a spool-shaped attachment member with a first flange and a second flange, the first flange having a larger diameter than the second flange, the second flange sized to extend through the body's central opening and the first flange sized to not be capable of extending through the central opening.

10. The tie-wire holster of claim 9, further comprising a roll of wire positioned within the holster body, the wire having a gauge between 14 and 18 and a free end of the wire extending out of the central opening of the first sidewall.

11. The tie-wire holster of claim 10, wherein the roll of wire has two retaining segments positioned such that the retaining segments may be accessed and cut through the slots in first sidewall.

12. A tie-wire holster comprising:

(a) a tire-shaped body formed of a flexible polymer material having a Shore A hardness of between about 15 and about 75, the body including a top circumferential portion and first and second radially inward extending sidewalls;

(b) the body having an outer diameter and a first sidewall having a central opening;

(c) at least one slot formed in the first sidewall, the slot extending from the central opening of the first sidewall at least half a distance to the top circumferential portion; and (d) wherein the slot is configured to enable the sidewall to spread apart sufficiently to insert a roll of tie-wire into the holster body.

13. The tie-wire holster of claim 12, wherein the Shore A hardness of the flexible polymer material is between about 25 and about 70.

14. The tie-wire holster of claim 12, wherein the Shore A hardness of the flexible polymer material is between about 35 and about 65.

15. The tie-wire holster of claim 12, further comprising at least two slots formed in the first sidewall and the slots extending at least two-thirds the distance to the top circumferential portion.

16. The tie-wire holster of claim 15, wherein the at least two slots are positioned at approximately equal angular distances from one another.

17. The tie-wire holster of claim 15, wherein the slots in the first sidewall are larger at an end extending into the top circumferential portion.

18. The tie-wire holster of claim 17, wherein the polymer material around the slot ends extending into the top circumferential portion includes a reinforcing mesh material.

19. The tie-wire holster of claim 12, further comprising a spool-shaped attachment member with a first flange and a second flange, the first flange having a larger diameter than the second flange, the second flange sized to extend through though a second opening on the body, and the first flange sized to not be capable of extending through the second central opening.

20. The tie-wire holster of claim 12, wherein the body has an outer diameter between about 3.5 and about 7 inches, and the sidewalls have a central opening between about 0.5 and about 5 inches in diameter.

* * * * *